US008917230B2

(12) United States Patent
Shin et al.

(10) Patent No.: US 8,917,230 B2
(45) Date of Patent: Dec. 23, 2014

(54) BACKLIGHT ASSEMBLY HAVING CURRENT DETECTION CIRCUIT AND DISPLAY APPARATUS HAVING THE SAME

(75) Inventors: Ho-Sik Shin, Anyang-si (KR); Seokhyun Nam, Seoul (KR); Young-Min Park, Seoul (KR); Yu-Dong Kim, Asan-si (KR); Jung-Hyun Yang, Seoul (KR)

(73) Assignee: Samsung Display Co., Ltd. (KR)

( * ) Notice: Subject to any disclaimer, the term of this patent is extended or adjusted under 35 U.S.C. 154(b) by 647 days.

(21) Appl. No.: 12/909,239

(22) Filed: Oct. 21, 2010

(65) Prior Publication Data

US 2011/0181625 A1 Jul. 28, 2011

(30) Foreign Application Priority Data

Jan. 25, 2010 (KR) ..... 10-2010-0006478

(51) Int. Cl.
*G09G 3/36* (2006.01)
*H05B 33/08* (2006.01)

(52) U.S. Cl.
CPC ..... *H05B 33/0851* (2013.01); *H05B 33/0815* (2013.01)
USPC ..... 345/102

(58) Field of Classification Search
CPC ..... G09G 3/3406; G09G 3/3426
USPC ..... 345/102
See application file for complete search history.

(56) References Cited

U.S. PATENT DOCUMENTS

2003/0227257 A1* 12/2003 Serizawa et al. ..... 315/77
2006/0001381 A1* 1/2006 Robinson et al. ..... 315/185 R
2006/0071614 A1 4/2006 Tripathi et al.
2007/0097283 A1* 5/2007 Zhou et al. ..... 349/46
2007/0188112 A1* 8/2007 Kang et al. ..... 315/291
2007/0285031 A1* 12/2007 Shteynberg et al. ..... 315/294
2008/0093997 A1* 4/2008 Chen et al. ..... 315/224
2008/0094349 A1* 4/2008 Liao et al. ..... 345/102
2008/0111800 A1* 5/2008 Wang et al. ..... 345/204
2008/0136771 A1* 6/2008 Chen et al. ..... 345/102
2008/0170012 A1* 7/2008 S et al. ..... 345/82
2008/0174541 A1* 7/2008 Chen et al. ..... 345/102
2009/0021183 A1* 1/2009 Ye et al. ..... 315/291
2009/0128045 A1* 5/2009 Szczeszynski et al. ... 315/185 R (Continued)

FOREIGN PATENT DOCUMENTS

CN 1784930 A 6/2006
CN 101022000 A 8/2007

(Continued)

*Primary Examiner* — Adam J Snyder
(74) *Attorney, Agent, or Firm* — Cantor Colburn LLP

(57) ABSTRACT

A backlight assembly includes; a plurality of light source strings which receive a driving voltage to generate a light, a driving circuit including a channel terminal commonly connected to output terminals of the plurality of light source strings and which receives a feedback voltage through the channel terminal to control the driving voltage according to the feedback voltage, and a current detection circuit connected to the output terminals of the plurality of light source strings to receive currents from the plurality of light source strings and which turns off the driving circuit when at least one of the received currents is larger than a predetermined reference current.

16 Claims, 5 Drawing Sheets

(56) References Cited

U.S. PATENT DOCUMENTS

| | | | | |
|---|---|---|---|---|
| 2009/0146932 | A1* | 6/2009 | Osaka | 345/82 |
| 2009/0187925 | A1* | 7/2009 | Hu et al. | 719/327 |
| 2009/0189843 | A1* | 7/2009 | Han et al. | 345/102 |
| 2009/0225021 | A1* | 9/2009 | Ye et al. | 345/102 |
| 2009/0315481 | A1* | 12/2009 | Zhao | 315/297 |
| 2010/0148679 | A1* | 6/2010 | Chen et al. | 315/297 |
| 2011/0043114 | A1* | 2/2011 | Hsu et al. | 315/119 |

FOREIGN PATENT DOCUMENTS

| | | | |
|---|---|---|---|
| GB | 2434929 | | 8/2007 |
| JP | 2004-039684 | A | 2/2004 |
| JP | 2006164523 | A | 6/2006 |
| JP | 2009290183 | A | 12/2009 |
| KR | 100859562 | B1 | 9/2008 |
| KR | 1020090009585 | A | 1/2009 |
| WO | 2004100614 | | 11/2004 |

* cited by examiner

BACKLIGHT ASSEMBLY HAVING CURRENT DETECTION CIRCUIT AND DISPLAY APPARATUS HAVING THE SAME

This application claims priority to Korean Patent Application No. 2010-6478, filed on Jan. 25, 2010, and all the benefits accruing therefrom under 35 U.S.C. §119, the content of which in its entirety is herein incorporated by reference.

BACKGROUND OF THE INVENTION

1. Field of the Invention

The present invention relates to a backlight assembly capable of detecting an error caused by a current deviation between light source strings contained therein, and a display apparatus including the backlight assembly.

2. Description of the Related Art

A liquid crystal display ("LCD") includes a non-emissive LCD panel for displaying an image and a backlight assembly arranged under the LCD panel to supply light to the LCD panel. In general, the backlight assembly typically employs a cold cathode fluorescent lamp ("CCFL") as its light source. However, the CCFL may have drawbacks such as the use of a high voltage start-up voltage, a limited color reproducibility and the use of mercury (Hg) in its manufacturing.

However, an environmentally-friendly light emitting diode ("LED") that has low power consumption and superior color reproducibility is spotlighted as a light source for a next-generation backlight assembly due to high energy prices and a recognition of the value of energy conservation.

When the LED is employed as a light source for a backlight assembly, the backlight assembly typically includes a plurality of light emitting groups connected to each other in parallel, and each group includes a plurality of LEDs connected to each other in series.

BRIEF SUMMARY OF THE INVENTION

Exemplary embodiments of the present invention provide a backlight assembly capable of effectively detecting an error caused by a current deviation between light source strings supplying light to a display apparatus.

Exemplary embodiments of the present invention also provide a display apparatus including the backlight assembly.

According to exemplary embodiments of the present invention, a backlight assembly includes a plurality of light source strings, a driving circuit and a current detection circuit. The light source strings receives a driving voltage to generate a light. The driving circuit comprises a channel terminal commonly connected to output terminals of the light source strings. The driving circuit receives a feedback voltage through the channel terminal to control the driving voltage according to the feedback voltage. The current detection circuit is connected to the output terminals of the light source strings to receive currents from the light source strings and turns off the driving circuit when at least one of the received currents is larger than a predetermined reference current.

According to another exemplary embodiment of the present invention, a display apparatus includes a backlight assembly generating a light and a display panel which displays an image using the light received from the backlight assembly. The backlight assembly includes a boosting circuit, a light source unit, a driving circuit and a current detection circuit.

In such an exemplary embodiment, the boosting circuit boosts an input voltage to a driving voltage, and the light source unit comprises a plurality of light source strings which is commonly connected to an output terminal of the boosting circuit and receives the driving voltage to generate the light. The driving circuit comprises a channel terminal commonly connected to the light source strings and receives a feedback voltage through the channel terminal to control the voltage boosting circuit according to the feedback voltage. The current detection circuit is connected to the output terminals of the light source strings to receive currents from the light source strings and turns off the driving circuit when at least one of the received currents is larger than a predetermined reference current.

Thus, according to exemplary embodiments as described herein, the current detection circuit which is connected to the output terminals of the light source strings to receive currents flowing through the light source strings is provided. The current detection circuit compares the received currents with the reference current. When at least one of the currents is larger than the reference current, the current detection circuit detects an error caused by a current deviation and turns off the driving circuit.

Therefore, a backlight assembly according to an exemplary embodiment of the present invention may effectively detect an open or short state of a light source string contained therein.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
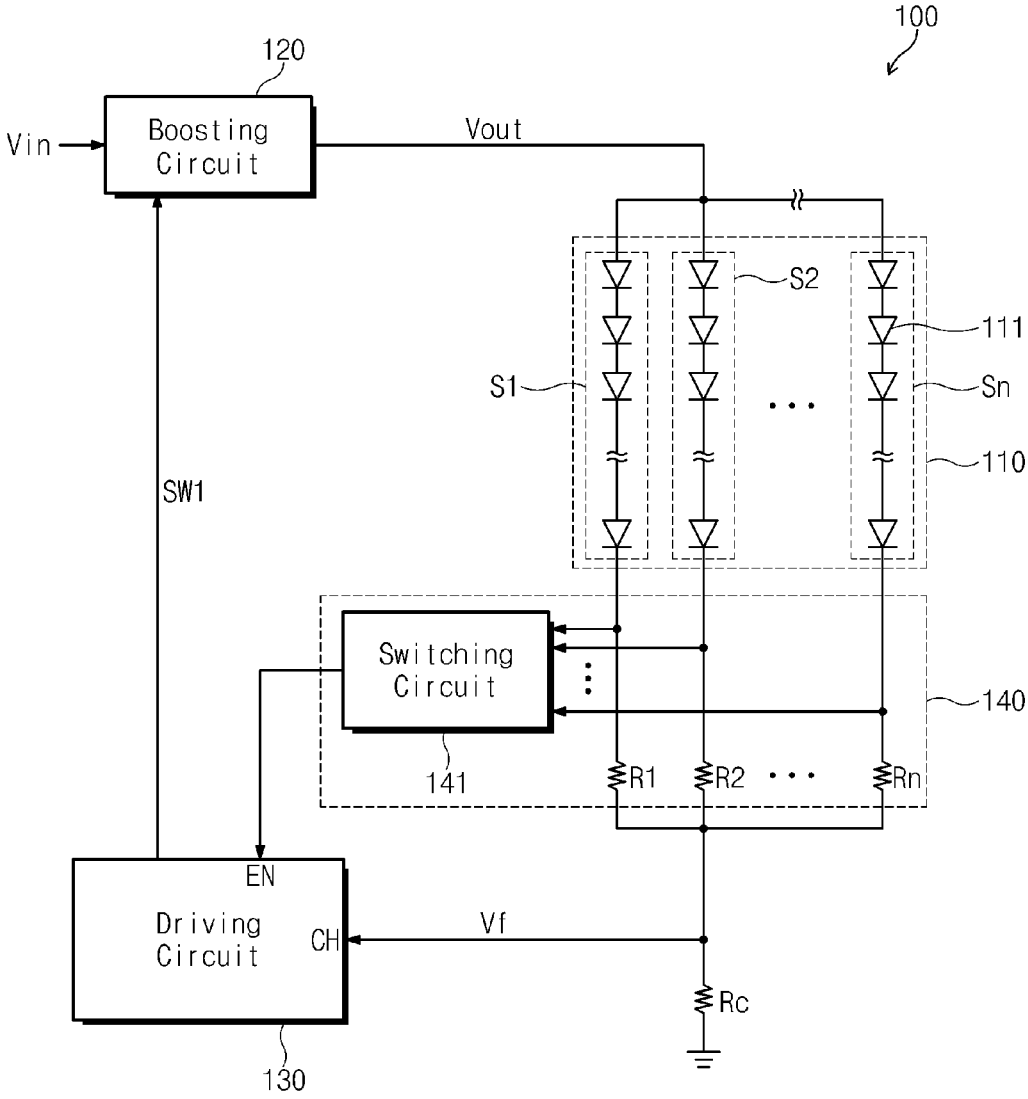
FIG. 1 is a block diagram of an exemplary embodiment of a backlight assembly according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the present invention will be described in further detail with reference to the accompanying drawings.

Figure 2:
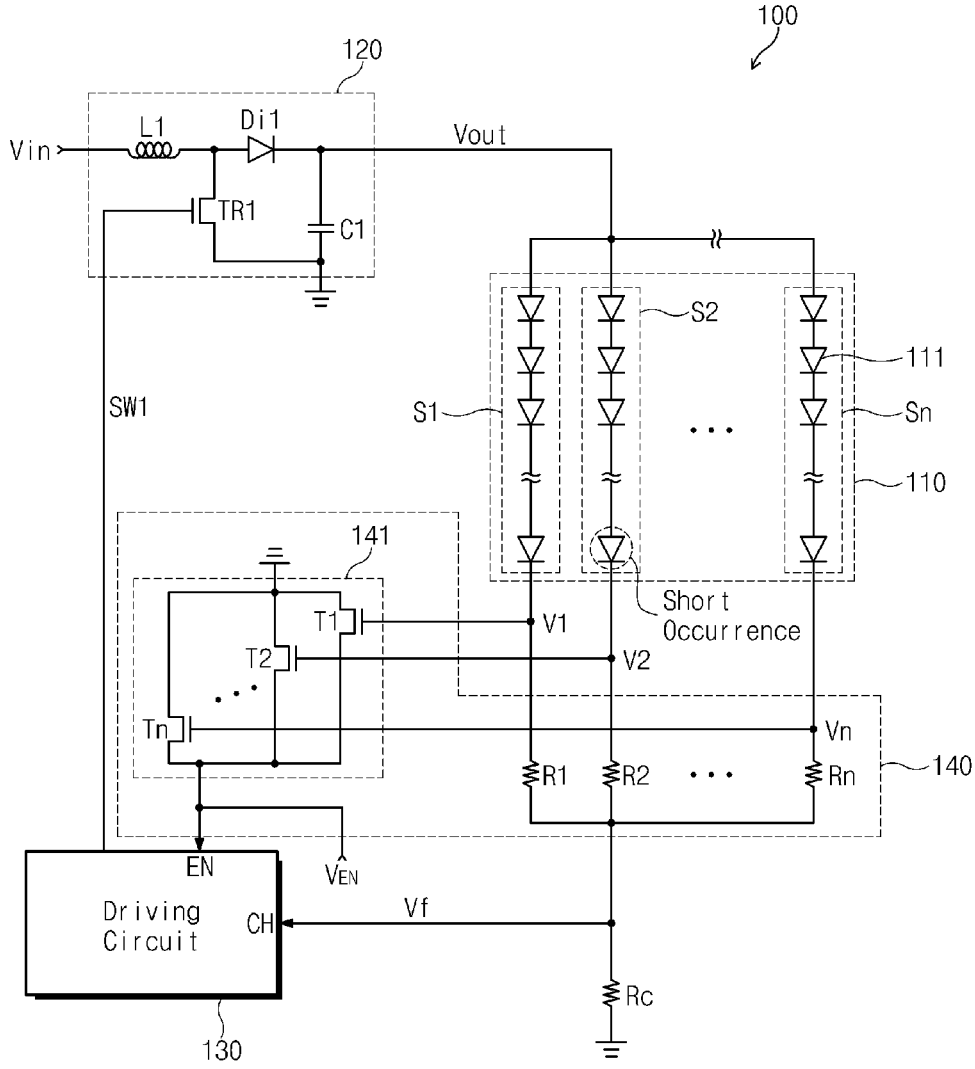
FIG. 2 is a circuit diagram of an exemplary embodiment of a current detection circuit of the backlight assembly of FIG. 1.

FIG. 1 is a block diagram of an exemplary embodiment of a backlight assembly according to the present invention, and FIG. 2 is a circuit diagram of an exemplary embodiment of a current detection circuit of the backlight assembly of FIG. 1.

Referring to FIGS. 1 and 2, the backlight assembly 100 includes a light source unit 110, a boosting circuit 120, a driving circuit 130 and a current detection circuit 140.

The light source unit 110 includes a plurality of light source strings S1~Sn connected in parallel to each other, and each light source string has a plurality of light emitting diodes ("LEDs") 111 connected to each other in series, where n is a natural number equal to or larger than 2. Alternative exemplary embodiments may include configurations wherein each light source string S1~Sn may include only one LED 111.

The boosting circuit 120 includes a direct-current-to-direct-current ("DC-DC") converter to boost an input voltage (for example, about 12 Volts (V)) Vin to a driving voltage Vout and output the driving voltage Vout. The driving voltage is used to drive the light source strings S1~Sn of the light source unit 110 and has a voltage level of about 20 V to about 35 V.

More specifically, as shown in FIG. 2, the boosting circuit 120 may include a coil L1, a diode Di1, a capacitor C1 and a transistor TR1. The transistor TR1 has a control terminal connected to the driving circuit 130 to receive a switching signal SW1 therefrom. Accordingly, the boosting circuit 120 may adjust the voltage level of the driving voltage Vout in response to the switching signal SW1.

The boosting circuit 120 has an output terminal commonly connected to input terminals of the light source strings S1~Sn, so that each of the light source strings S1~Sn may receive the driving voltage Vout.

The driving circuit 130 may be integrated in a chip set and include a channel CH commonly connected to output terminals of the light source strings S1~Sn. The driving circuit 130 receives a feedback voltage Vf from the light source unit 110 through the channel CH. In addition, in one exemplary embodiment a resistor Rc may be connected between the channel CH and a ground terminal.

The driving circuit 130 controls the switching signal SW1 according to a voltage level of the feedback voltage Vf. More specifically, the driving circuit 130 decreases a duty ratio of the switching signal SW1 when the feedback voltage Vf is larger than a predetermined reference voltage. On the contrary, when the feedback voltage Vf is smaller than the reference voltage, the driving circuit 130 increases the duty ratio of the switching signal SW1. As mentioned above, since the duty ratio of the switching signal SW1 is adjusted according to the magnitude of the feedback voltage Vf, the voltage level of the driving voltage Vout output from the boosting circuit 120 may be controlled according to the level of the feedback voltage Vf. Consequently, the light source unit 110 may output light therefrom at a constant brightness.

Although not shown in FIGS. 1 and 2, the driving circuit 130 may receive a pulse width modulation ("PWM") dimming signal. The PWM dimming signal is used to control a duty ratio of each light source string S1~Sn. Accordingly, the driving circuit 130 may control the brightness of the light source unit 110 according to the PWM dimming signal.

The current detection circuit 140 includes a switching circuit 141 and a plurality of resistors R1~Rn. The switching circuit 141 is connected to the output terminals of the light source strings S1~Sn and receives currents therefrom through the output terminals. Also, the switching circuit 141 is connected to an enable terminal EN of the driving circuit 130. Therefore, the switching circuit 141 may disable the driving circuit 130 when at least one of the currents provided through the output terminals is larger than a predetermined reference current.

As shown in FIG. 2, the switching circuit 141 includes a plurality of switching devices T1~Tn. Each of the switching devices T1~Tn has a first electrode connected to an output terminal of a corresponding light source string among the light source strings S1~Sn, a second electrode connected to a ground terminal, and a third electrode connected to the enable terminal EN of the driving circuit 130. As an example, in one exemplary embodiment each switching device T1~Tn may be a field effect transistor ("FET").

The third electrodes of the switching devices T1~Tn are commonly connected to the enable terminal EN of the driving circuit 130. The enable terminal EN is applied with an enable voltage $V_{EN}$ via a voltage input as shown in FIG. 2.

Thus, when at least one of the switching devices T1~Tn is turned on the input enable voltage $V_{EN}$ is applied to the ground terminal, and thus a ground voltage is applied to the enable terminal EN instead of the enable voltage $V_{EN}$, so that the driving circuit 130 is disabled.

On the other hand, the resistors R1~Rn are connected to the switching devices T1~Tn, respectively. In detail, each of the resistors R1~Rn is connected between a first electrode of a corresponding switching device among the switching devices T1~Tn and the channel CH of the driving circuit 130.

Each resistor R1~Rn may have a size depending upon a threshold voltage of each of the switching devices T1~Tn. That is, each resistor R1~Rn may have a size by which the corresponding switching device is maintained at a turned-off state when a corresponding light source string S1~Sn is in a normal operating state. In other words, when a light source string is in a normal operating state, e.g., there are no electrical shorts therein, the corresponding resistor of the resistors R1~Rn is appropriately sized such that the corresponding switching device is maintained in a turned off state, and if all light source strings S1~Sn are in the normal operating state, the enable voltage $V_{EN}$ is applied to the enable terminal EN of the driving circuit 130.

In additional, if the resistors R1~Rn are respectively connected to the output terminals of the light source strings S1~Sn, a voltage deviation between the light source strings S1~Sn may decrease, i.e., voltages applied to the plurality of light source strings S1~Sn will be more uniformly distributed across the plurality of light source strings S1~Sn. The voltage deviation decreases as the size of each resistor R1~Rn increases, but the size of each resistor R1~Rn depends upon the threshold voltage of the corresponding switching device T1~Tn. Accordingly, the size of each resistor R1~Rn may be adjusted considering the threshold voltage and the voltage deviation, e.g., the size of each resistor R1~Rn may be selected to minimize the voltage deviation while maintaining the voltage applied to the switching devices T1~Tn below the threshold voltage.

Figure 3:
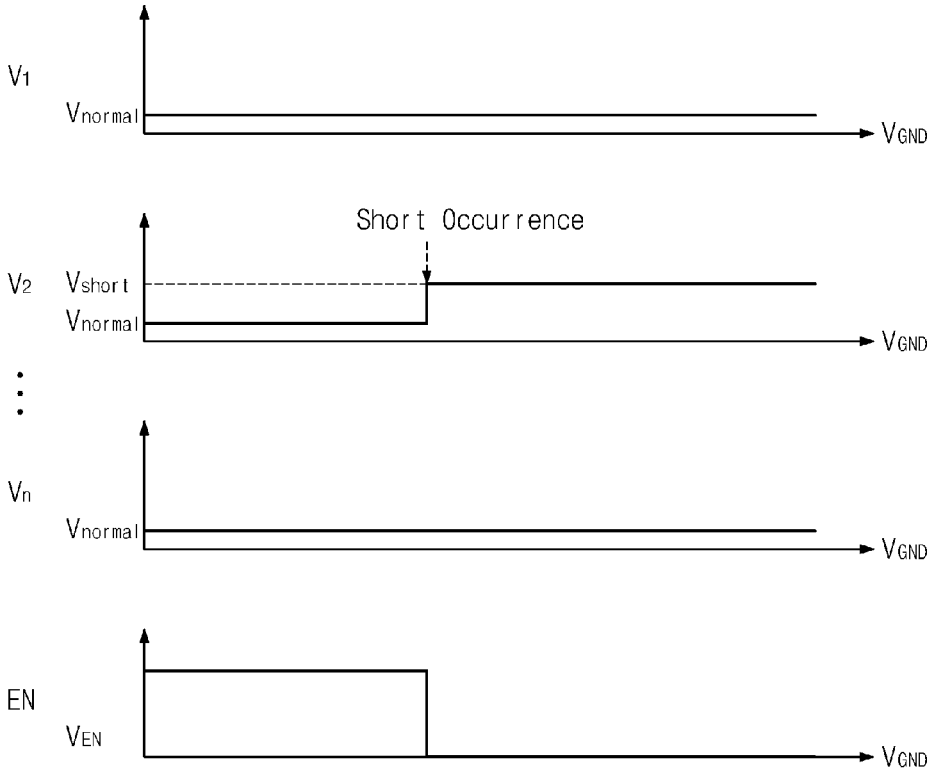
FIG. 3 is a timing diagram for input/output voltage of the exemplary embodiment of a current detection circuit shown in FIG. 2.

FIG. 3 is a timing diagram for input/output voltage of the exemplary embodiment of a current detection circuit shown in FIG. 2.

Referring to FIGS. 2 and 3, electric potentials at the output terminals of the light source strings S1~Sn are referred to as a first voltage to an n-th voltage V1~Vn, respectively, and the first to n-th voltages V1 to Vn may have a normal voltage level Vnormal if all the light source strings S1~Sn are operating in a normal mode of operation, e.g., if there are no electrical shorts or arc currents, etc.

For instance, when at least one LED among the LEDs 111 that are included in the second light source string S2 among the lights source strings S1~Sn, is shorted, the driving current of the second light source string S2 increases, e.g., due to the loss of resistance of the shorted LED 111. In this case, a second voltage V2 among the first to n-th voltages V1~Vn increases to a voltage level Vshort that is higher than the normal level Vnormal due to the increased driving current and a second resistor R2 among the resistors R1~Rn, which is connected to an output terminal of the second light source string S2. More specifically, when the short occurs, the second voltage V2 increases to a voltage level equal to or larger than the threshold voltage of the switching devices T1~Tn, specifically equal to or larger than the threshold voltage of the switching device T2.

Therefore, a second switching device T2 among the switching devices T1~Tn is turned on by the increased second voltage V2. The enable voltage $V_{EN}$ is discharged through the turned-on second switching device T2 and a ground voltage $V_{GND}$ is applied to the enable terminal EN of the driving circuit 130. Consequently, when the short occurs, the driving circuit 130 may be converted to a disabled state.

Although not shown in figures, in case that one of the light source strings S1~Sn is opened, i.e., the electrical path through the light source string is severed, driving currents of remaining light source strings that are not opened increase. Accordingly, the increased driving current increases the electrical potential of nodes between the output terminals of the remaining light source strings and the resistors R1~Rn. Consequently, the switching devices connected to the nodes of the remaining light source strings are turned on by the increased electric potential, thereby disabling the driving circuit 130.

As a result, the current detection circuit 140 may detect an electrical short or an open condition in the light source strings S1~Sn, to thereby disable the driving circuit 130.

Figure 4:
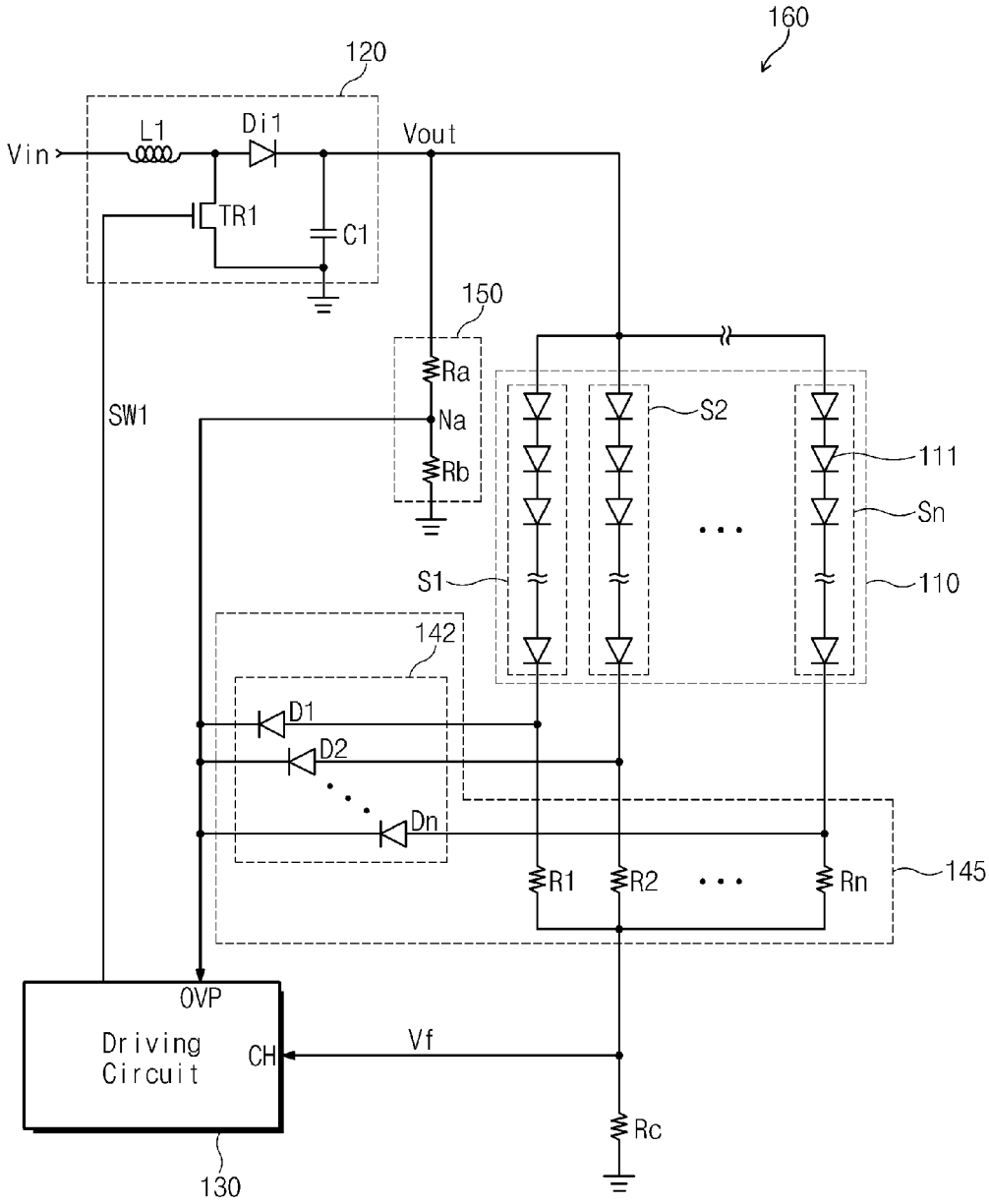
FIG. 4 is a circuit diagram of another exemplary embodiment of a backlight assembly according to the present invention.

FIG. 4 is a circuit diagram of another exemplary embodiment of a backlight assembly according to the present invention. In FIG. 4, the same reference numerals denote the same or like elements as shown in FIG. 2, and any detailed repetitive description thereof will hereinafter be omitted.

Referring to FIG. 4, a backlight assembly 160 includes the light source 110, the boosting circuit 120, the driving circuit 130, a current detection circuit 145, and an over-voltage detection circuit 150.

The over-voltage detection circuit 150 includes a first resistor Ra and a second resistor Rb, which are connected to each other in series between the output terminal of the boosting circuit 120 and a ground terminal. The over-voltage detection circuit 150 provides an electrical potential of a connection node Na between the first and second resistors Ra and Rb, and the connection node Na is connected to the driving circuit 130. The driving circuit 130 has a protection terminal OVP connected with the connection node Na to perform a self-protection operation when the electrical potential of the connection node Na is equal to or greater than a predetermined reference electric potential.

The current detection circuit 145 includes a switching circuit 142 having a plurality of diodes D1~Dn connected to the output terminals of the light source strings S1~Sn, respectively. In particular, each diode D1~Dn has an anode connected an output terminal of a corresponding light source string of the light source strings S1~Sn and a cathode connected to the connection node Na. In addition, the cathodes of the diodes D1~Dn are commonly connected to the protection terminal OVP. Therefore, if at least one of the diodes D1~Dn is turned on, a voltage is applied to the protection terminal OVP and the protection operation of the driving circuit 130 may be performed.

The current detection circuit 145 further includes a plurality of resistors R1~Rn connected to the diodes D1~Dn and the light source strings S1~Sn, respectively. Each resistor R1~Rn is connected between the anode of a corresponding diode among the diodes D1~Dn and the channel CH of the driving circuit 130.

In the present exemplary embodiment, the combined resistance of the each light source string S1~Sn and it's corresponding resistor R1~Rn is less than a resistance of the first and second resistors Ra and Rb. Accordingly, the driving current flowing through the light source strings S1~Sn is not introduced into the protection terminal OVP while the light source strings S1~Sn are operated in a normal state of operation.

The diodes D1~Dn may prevent the current from the overvoltage detection circuit 150 from being introduced into the light source strings S1~Sn.

If one of the light source strings S1~Sn is shorted, the driving current flowing through the shorted light source string increases. Therefore, the diode connected to the output terminal of the shorted light source string is turned on, i.e., significant current flows through the diode, so that the voltage applied to the protection terminal OVP of the driving circuit 130 increases. Accordingly, the driving circuit 130 performs the protection operation when the voltage received through the protection terminal OVP is larger than the reference voltage.

In contrast, if one of the light source strings S1~Sn is opened, the driving current flowing through remaining light source strings that are not opened increases. In this case, the diodes connected to the output terminals of the remaining light source strings are turned on, so that voltage applied to the protection terminal OVP of the driving circuit 130 increases and the driving circuit 130 thereby performs the protection operation.

Consequently, the current detection circuit 145 may detect a short or open in the light source strings S1~Sn, thereby turning off the driving circuit 130 according to a detected result.

Figure 5:
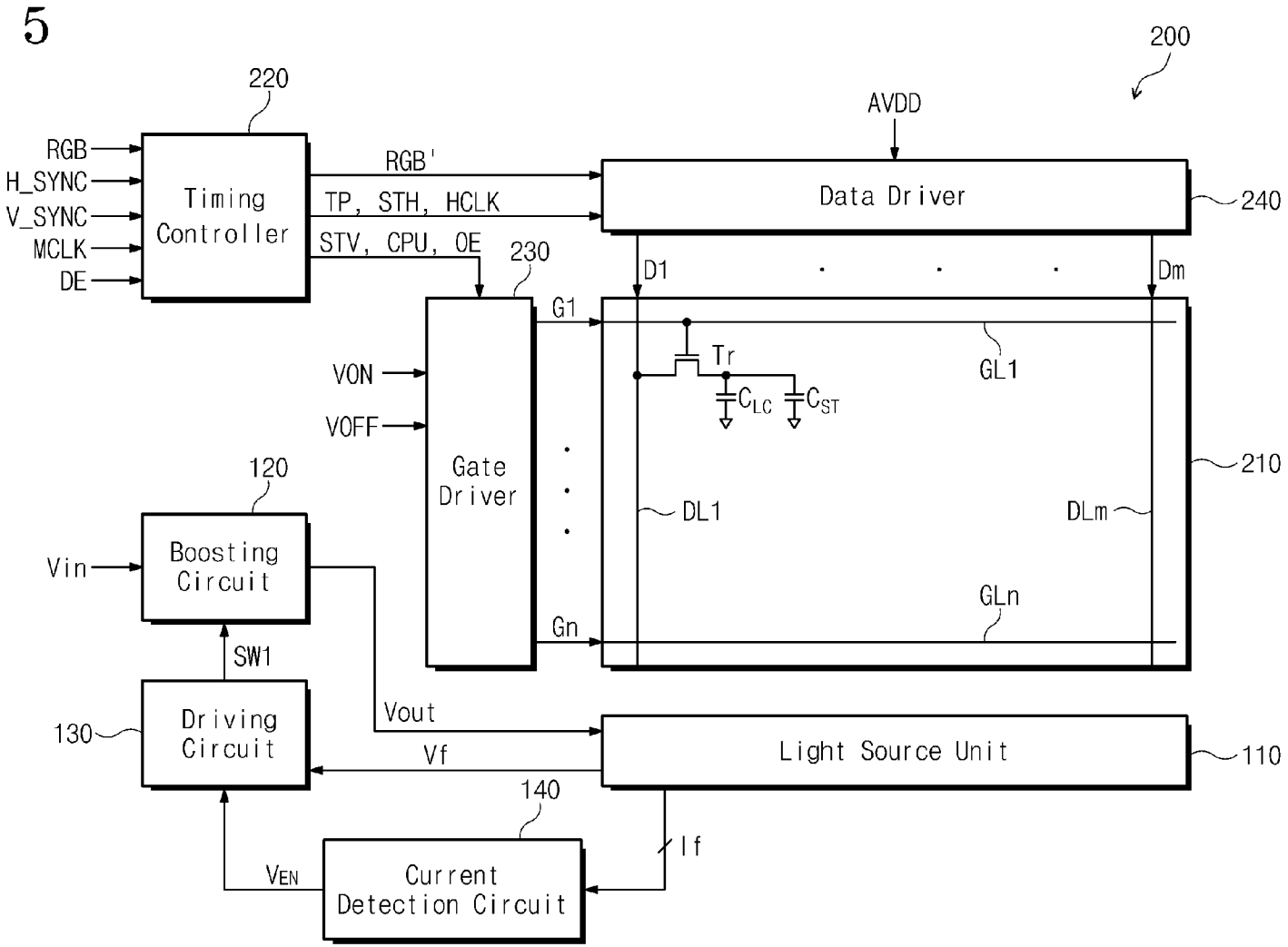
FIG. 5 is a block diagram of an exemplary embodiment of a liquid crystal display ("LCD") including the backlight assembly of FIG. 1.

FIG. 5 is a block diagram of an exemplary embodiment of a liquid crystal display ("LCD") including the exemplary embodiment of a backlight assembly of FIG. 1. In FIG. 5, the same reference numerals denote the same or like elements as shown in FIG. 1, and any detailed repetitive description thereof will hereinafter be omitted.

Referring to FIG. 5, an LCD 200 includes an LCD panel 210, a timing controller 220, a gate driver 230, a data driver 240, the light source unit 110, the boosting circuit 120, the driving circuit 130 and the current detection circuit 140.

The LCD panel 210 includes gate lines GL1~GLn, data lines DL1~DLm disposed substantially perpendicular to the gate lines GL1~GLn, and a plurality of pixels. The pixels are respectively arranged in pixel areas in association with the gate lines GL1~GLn and the data lines DL1~DLm. Each of the plurality of pixels have substantially the same structure and function, and thus for the convenience of explanation, only one pixel has been shown in FIG. 5. Each pixel includes a thin film transistor ("TFT") Tr, a liquid crystal capacitor $C_{LC}$ and a storage capacitor $C_{ST}$. The TFT Tr has a gate electrode connected to a corresponding gate line of the gate lines GL1~GLn, a source electrode connected to a corresponding data line of the data lines DL1~DLm, and a drain electrode connected in parallel with the liquid crystal capacitor $C_{LC}$ and the storage capacitor $C_{ST}$.

In the present exemplary embodiment, the timing controller 220 receives image data signals RGB, a horizontal synchronizing signal H_SYNC, a vertical synchronizing signal V_SYNC, a clock signal MCLK, and a data enable signal DE. The timing controller 220 converts a data format of the image data signals RGB into a data format appropriate to an interface between the timing controller 220 and the data driver 240 and outputs the converted image data signals R'G'B' to the data driver 240. In addition, the timing controller 220 outputs data control signals, such as an output start signal TP, a horizontal start signal STH and a data clock signal HCLK, to the data driver 240, and outputs gate control signals, such as a vertical start signal STV, a gate clock signal CPV and an output enable signal OE, to the gate driver 230.

The gate driver 230 receives a gate-on voltage Von and a gate-off voltage Voff and sequentially outputs gate signals G1~Gn having the gate-on voltage Von in response to the gate control signals STV, CPV and OE provided from the timing controller 220. The gate signals G1~Gn are sequentially applied to the gate lines GL1~GLn of the LCD panel 210 to sequentially scan the gate lines GL1~GLn. Although not shown in FIG. 5, exemplary embodiments of the LCD 200 may further include a regulator to convert an input voltage into the gate-on voltage Von or the gate-off voltage Voff. In such exemplary embodiments, the regulator may receive a voltage different from the input voltage applied to the boosting circuit 120.

The data driver 240 may operate by receiving an analog data voltage AVDD and generate a plurality of gray-scale voltages using gamma voltages provided from a gamma voltage generator (not shown). The data driver 240 selects gray-scale voltages corresponding to the image data signals R'G'B' from among the generated gray-scale voltages in response to the data control signals TP, STH and HCLK provided from the timing controller 220 and applies the selected gray-scale voltages to the data lines DL1~DLm of the LCD panel 210 as the data signals D1~Dn.

For instance, if the gate signal is applied to the corresponding gate line selected from the gate lines GL1~GLn, the TFT Tr connected to the selected gate line is turned on in response to the gate signal applied to the selected gate line. Therefore, the data signal applied to the data line connected to the turned-on TFT Tr is charged to the liquid crystal capacitor $C_{LC}$ and the storage capacitor $C_{ST}$ through the turned-on TFT Tr.

The liquid crystal capacitor $C_{LC}$ is charged with a voltage which controls an orientation of the liquid crystal molecules contained therein, which in turn controls a light-transmittance of the liquid crystals contained therein. The storage capacitor $C_{ST}$ stores the data signal when the TFT Tr is turned on and applies the stored data signal to the liquid crystal capacitor $C_{LC}$ when the TFT Tr is turned off, so that the liquid crystal capacitor $C_{LC}$ may maintain the voltage charged thereto. As a result, the LCD panel 210 may display images by varying the light-transmittance of the plurality of pixels.

The light source unit 110 is disposed at a rear of the LCD panel 210 and supplies light to the LCD panel 210 in response to the driving voltage Vout provided from the boosting circuit 120. The light source unit 110 provides light to the LCD panel 210 so that the plurality of pixels may vary a transmittance of the light passing therethrough. Although not shown in FIG. 5, the light source unit 110 may be disposed directly under the LCD panel 210 or disposed under an edge portion of the liquid crystal display panel 210 or in various other orientations.

The light source unit 110 includes a plurality of light source strings S1~Sn connected to the driving circuit 130 through the channel CH. The current detection circuit 140 is provided between the light source unit 110 and the driving circuit 130. If one of the light source strings S1~Sn is shorted or opened, the current detection circuit 140 detects a current deviation among the light source strings S1~Sn and controls an operation of the driving circuit 130 according to the detected result. Thus, the LCD 200 employing the driving circuit 130 having a single channel may effectively detect an open or short state of the light source strings S1~Sn.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A backlight assembly comprising:

a plurality of light source strings which receive a driving voltage to generate a light;

a driving circuit comprising a channel terminal commonly connected to output terminals of the plurality of light source strings and which receives a feedback voltage through the channel terminal to control the driving voltage according to the feedback voltage; and a current detection circuit connected to the output terminals of the plurality of light source strings to receive currents from the plurality of light source strings and which turns off the driving circuit when at least one of the received currents is larger than a predetermined reference current, wherein the current detection circuit comprises a plurality of switching devices, wherein gate terminals of the plurality of switching devices are respectively and directly connected to the plurality of light source strings, wherein each switching device comprises a second electrode to which a ground voltage is applied, and a third electrode connected to the enable terminal of the driving circuit, and wherein an enable voltage is applied to the third electrode via an input terminal.

2. The backlight assembly of claim 1, wherein the enable terminal is connected to the third electrode of each switching device to turn off the driving circuit when at least one of the switching devices is turned on.

3. The backlight assembly of claim 1, wherein the current detection circuit comprises a plurality of resistors respectively connected to the plurality of switching devices, and each resistor is connected between the first electrode of a corresponding switching device of the plurality of switching devices and the channel of the driving circuit.

4. The backlight source unit of claim 3, wherein each resistor has a predetermined resistance selected such that the corresponding switching device is maintained at a turned-off state when a light source string corresponding the each resistor operates in a normal operating state.

5. The backlight assembly of claim 1, further comprising a boosting circuit which boosts an input voltage to the driving voltage and outputs the driving voltage, and wherein the driving circuit controls the boosting circuit according to the feedback voltage to adjust a voltage level of the driving voltage.

6. The backlight assembly of claim 5, wherein the boosting circuit comprises an output terminal to output the driving voltage and the output terminal of the boosting circuit is commonly connected to input terminals of the plurality of light source strings.

7. A backlight assembly comprising:

a plurality of light source strings which receive a driving voltage to generate a light;

a driving circuit comprising a channel terminal commonly connected to output terminals of the plurality of light source strings and which receives a feedback voltage through the channel terminal to control the driving voltage according to the feedback voltage; and a current detection circuit connected to the output terminals of the plurality of light source strings to receive currents from the plurality of light source strings and which turns off the driving circuit when at least one of the received currents is larger than a predetermined reference current, a first resistor and a second resistor which are connected to each other in series between input terminals of the plurality of light source strings which receive the driving voltage and a ground terminal; and an over-voltage detection circuit which supplies an electrical potential of a connection node between the first resistor and the second resistor to the driving circuit, wherein the driving circuit comprises a protection terminal connected to the connection node to turn off the driving circuit when the electric potential of the connection node is equal to or larger than a predetermined reference electric potential, and the current detection circuit is connected to the protection terminal of the driving circuit, wherein each switching device of the current detection circuit comprises a diode having an anode connected to an output terminal of the corresponding light source string and a cathode connected to the connection node.

8. The backlight assembly of claim 7, wherein the cathode of the each switching device is connected to the protection terminal to turn off the driving circuit when at least one of the switching devices is turned on.

9. The backlight assembly of claim 7, wherein the current detection circuit further comprises a plurality of resistors respectively connected to the plurality of switching devices, and each resistor is connected between the anode of a corresponding switching device of the plurality of switching devices and the channel of the driving circuit.

10. The backlight assembly of claim 9, wherein the each resistor has a resistance less than that of each of the first resistor and the second resistor.

11. The backlight assembly of claim 7, wherein the current detection circuit comprises a plurality of switching devices respectively connected to the plurality of light source strings, and each switching device of the plurality of switching devices operates according to a level of current from a corresponding light source string of the plurality of light source strings.

12. A display apparatus comprising:

a backlight assembly which generates a light; and a display panel which receives the light and displays an image using the light, wherein the backlight assembly comprises:

a boosting circuit which boosts an input voltage to a driving voltage;

a light source unit comprising a plurality of light source strings commonly connected to an output terminal of the boosting circuit, wherein the plurality of light source strings receives the driving voltage to generate the light;

a driving circuit comprising a channel terminal commonly connected to the plurality of light source strings and which receives a feedback voltage through the channel terminal to control the boosting circuit according to the feedback voltage; and a current detection circuit connected to output terminals of the plurality of light source strings to receive currents from the plurality of light source strings, wherein the current detection circuit turns off the driving circuit when at least one of the received currents is larger than a predetermined reference current, wherein the current detection circuit comprises a plurality of switching devices, wherein gate terminals of the plurality of switching devices are respectively and directly connected to the plurality of light source strings, wherein each switching device comprises a second electrode to which a ground voltage is applied, and a third electrode connected to the enable terminal of the driving circuit, and wherein an enable voltage is applied to the third electrode via an input terminal.

13. The display apparatus of claim 12, wherein the current detection circuit comprises a plurality of resistors respectively connected to the plurality of switching devices, and each resistor is connected between the first electrode of a corresponding switching device of the plurality of switching devices and the channel terminal of the driving circuit.

14. The display apparatus of claim 12, wherein the backlight assembly further comprises:

a first resistor and a second resistor, the first resistor and the second resistors being connected to each other in series between input terminals of the plurality of light source strings which receive the driving voltage and a ground terminal; and an over-voltage detection circuit which supplies an electrical potential of a connection node disposed between the first resistor and the second resistor to the driving circuit.

15. The display apparatus of claim 14, wherein each switching device of the current detection circuit comprises a diode having an anode connected to an output terminal of the corresponding light source string and a cathode connected to the connection node.

16. The display apparatus of claim 15, wherein the driving circuit comprises a protection terminal connected to the connection node to turn off the driving circuit when the electrical potential of the connection node is equal to or larger than a predetermined reference electrical potential.

* * * * *